US007022994B2

(12) United States Patent
Fuchs et al.

(10) Patent No.: US 7,022,994 B2
(45) Date of Patent: Apr. 4, 2006

(54) RADIATION CONVERTER

(75) Inventors: Manfred Fuchs, Nürnberg (DE); Erich Hell, Erlangen (DE); Wolfgang Knüpfer, Erlangen (DE); Detlef Mattern, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 31 days.

(21) Appl. No.: 10/239,547

(22) PCT Filed: Mar. 22, 2001

(86) PCT No.: PCT/DE01/01109

§ 371 (c)(1),
(2), (4) Date: Jan. 21, 2003

(87) PCT Pub. No.: WO01/71381

PCT Pub. Date: Sep. 27, 2001

(65) Prior Publication Data

US 2003/0164682 A1 Sep. 4, 2003

(30) Foreign Application Priority Data

Mar. 23, 2000 (DE) ..... 100 14 311

(51) Int. Cl.
*H01J 40/18* (2006.01)

(52) U.S. Cl. ..... 250/361 R

(58) Field of Classification Search ..... 250/361 R, 250/214 VT

See application file for complete search history.

(56) References Cited

U.S. PATENT DOCUMENTS

| | | | | |
|---|---|---|---|---|
| 3,491,233 | A | 1/1970 | Manley | |
| 3,609,359 | A * | 9/1971 | Wainer et al. | 250/315.3 |
| 3,710,125 | A * | 1/1973 | Jacobs et al. | 250/214 VT |
| 3,846,630 | A | 11/1974 | Suhami et al. | |
| 4,345,153 | A | 8/1982 | Yin | |
| 4,376,892 | A | 3/1983 | Charpak et al. | |
| 4,886,970 | A | 12/1989 | Haendle | |
| 5,369,268 | A | 11/1994 | Van Aller et al. | |
| 5,532,475 | A | 7/1996 | Tonami et al. | |
| 5,686,721 | A | 11/1997 | Schmidt-Bocking | |
| 6,566,809 | B1 * | 5/2003 | Fuchs et al. | 313/528 |

FOREIGN PATENT DOCUMENTS

| | | | |
|---|---|---|---|
| DE | 2602863 | A1 * | 8/1976 |
| DE | 42 37 097 | A1 | 5/1993 |
| DE | 195 27 794 | A1 | 1/1997 |
| EP | 0 053 530 | A1 | 6/1983 |
| GB | 2269048 | A * | 1/1994 |

* cited by examiner

*Primary Examiner*—Constantine Hannaher
(74) *Attorney, Agent, or Firm*—Schiff Hardin LLP

(57) ABSTRACT

A radiation converter has a radiation absorber for generating photons dependent on the intensity of incident x-ray radiation, a photocathode arranged downstream of the radiation absorber in the radiation propagation direction at a distance therefrom and serving for generating electrons dependent on the photons emerging from the radiation absorber, a device for accelerating the electrons emerging from the photocathode onto an electron detector for generating electrical signals dependent on the impinging electrons, an electron multiplier arranged between the photocathode and the electron detector, the electrons emerging from the photocathode being multiplied by the electron multiplier.

13 Claims, 1 Drawing Sheet

RADIATION CONVERTER

BACKGROUND OF THE INVENTION

1. Field of the Invention

The present invention is directed to a radiation converter of the type suitable for use in an x-ray system.

2. Description of the Prior Art

German OS 33 32 648 discloses a radiation converter embodied as an image intensifier. Such image intensifiers have an input window with a radiation absorber for generating light photons in a manner dependent on the radiation intensity of impinging radiation. Arranged downstream of the radiation absorber is a photocathode which generates electrons in a manner dependent on the light photons emerging from the radiation absorber. The electrons are accelerated onto an electron receiver by an electrode system. In the case of the image intensifier, the electron receiver is embodied as an output screen which generates light photons dependent on the impinging electrons.

U.S. Pat. No. 5,369,268 discloses an x-ray detector in which the photocathode is applied on a radiation absorber. The photocathode is arranged at a distance from and opposite an amorphous selenium layer of an output screen.

A further detector device is disclosed in German OS 44 29 925. In this case, a shadowmask produced from wires is provided on the radiation input side, a chevron plate being connected downstream of this shadowmask. In order to generate an image signal, a low-impedance anode structure is provided outside the detector on the rear side thereof. European Application 0 053 530 discloses a photodetector in which an electron multiplier and a detector anode are connected downstream of a photocathode in the radiation direction.

Since, in the case of medical examination of a patient, in contrast to nondestructive materials testing, the radiation loading must be kept as small as is technically practical, in order to minimize the radiation loading on the patient, efficient utilization of the radiation which penetrates through the patient and strikes the radiation receiver is the highest requirement. The smaller the radiation intensity on the radiation receiver, however, the smaller are the signals which can be derived from the radiation receiver. The distance between the signal levels and the noise signals likewise becomes smaller, which is associated with a poorer diagnosis capability of the image representations that can be generated on the basis of these signals. It is thus necessary to make a compromise between a small radiation loading on the patient and the radiation dose required for a good diagnosis capability of radiographic images of the patient that can be generated.

A photographic film is, for example, nothing more than a chemical amplifier which amplifies the ionization processes of the radiation in the microscopic region by many orders of magnitude and makes them visible in the macroscopic region.

Storage phosphor panels store the radiation shadow image of an object in latent fashion. By scanning the storage phosphor panel using a light beam, light photons are generated dependent on the latent image and are converted by a read-out with a photomultiplier into electrons which can be amplified virtually in noise-free fashion by up to a factor of $10^6$, and converted into electrical signals. These electrical signals then are available for the image representation.

In x-ray image intensifiers, the geometrical size reduction which results due to the large input window and the smaller output window is used for intensifying the luminance, assistance for this being provided by the energy absorption of the electrons from the input fluorescent screen to the output fluorescent screen through an intervening acceleration field.

In the case of so-called flat panel image detectors, a layer which converts radiation into light and has CsI, for example, is brought into direct contact with a photodiode matrix made of amorphous silicon, so that the light photons generated by the layer due to incident radiation can be converted by means of the photodiode matrix into electrical signals, which are then available for the image representation. Since the light photons are not amplified by means of electrons, only relatively small signals can be derived from the photodiode matrix, which signals can be amplified only in a device connected downstream, e.g. an amplifier. Since the quantities of charge of these relatively small electrical signals then also must be additionally conducted, by means of complicated timing methods, from the large-area flat panel image detectors via relatively long lines as far as the amplifiers, the average noise, measured in electrons, is almost twice as great as the signal generated by individual x-ray quanta. Particularly for fluoroscopy, in which only small x-ray doses are applied, the signals which can be derived from the flat panel image detector are particularly small and near the region of the noise and thus require complicated artifact corrections. In fluoroscopy, as an example, the signals of every other beam scanning are used for correction purposes, so that nothing comparable to the customary image refresh rates can be achieved. Moreover, the dynamic range of the signals which can be derived from the flat panel image detector is greatly restricted.

In today's flat panel image detectors, predominantly a-Si:H read-out panels are used as electron detectors. Operation of such flat panel image detectors in different operating modes, such as fluoroscopy and radiography, which differ by dose factors of 100–1000, requires a high computation complexity. In the transition from the radiography operating mode, operated with a high dose, to the fluoroscopy operating mode, operated with a low dose, residual images in the a-Si:H read-out panel must be removed computationally by subtraction.

SUMMARY OF THE INVENTION

It is an object of the invention to provide a radiation converter which can be used as universally as possible. It is a further aim to improve the dynamic range of such a radiation converter.

The above object is achieved in accordance with the principles of the present invention in a radiation converter having a radiation absorber for generating photons dependent on the intensity of x-rays incident thereon, a photocathode disposed downstream of the radiation absorber in the radiation propagation direction at a distance therefrom, which generates electrons dependent on the photons emerging from the radiation absorber, a device for accelerating the electrons emerging from the photocathode onto an electron detector for generating electrical signals dependent on the incident electrons, and an electron multiplier connected between the photocathode and the electron detector for multiplying the electrons emerging from the photocathode.

In the radiation converter according to the invention, a distance is provided between the radiation absorber and the photocathode. As a result, the effect of UV photons which adversely influences the measurement can be reduced. The dynamic range of the radiation converter proposed is improved. A further advantage is that the photocathode no longer need be embodied in transparent fashion on account of the arrangement proposed here. It is thereby possible to attain a cost saving.

The distance is advantageously between 10 and 100 μm. A distance of about 50 mm has proved to be particularly advantageous. The photocathode expediently may be formed in opaque fashion. UV photons from the avalanche region cannot directly pass to the photocathode.

According to a further embodiment, the photocathode is produced from a metallic material which preferably contains gold, cesium, copper or antimony. It is expedient, furthermore, to form the photocathode as a layer on the electron multiplier, in which case the electron multiplier in turn may be formed as a layer on the electron detector. According to a particularly advantageous embodiment, the electron multiplier has a perforated plastic film, preferably produced from polyimide. The diameter of the holes is about 25 μm.

It is advantageous for the radiation absorber, the electrode system, the electron multiplier and the electron detector to be disposed in a common, gastight housing, thereby producing a compact construction of the radiation converter. A gas which absorbs UV photons preferably is accommodated in the housing. The gas may have at least one of the following constituents: argon, krypton, xenon, helium, neon, $CO_2$, $N_2$, hydrocarbon, dimethyl ether, methanol/ethanol vapor.

The radiation absorber advantageously converts radiation into light photons particularly when it has an acicular structure and is composed of CsI:Na.

In a particularly advantageous manner, the electron detector is embodied as a 2D thin-film panel and is composed of a-Se, a-Si:H or poly-Si. Such an electron detector has a simple construction and is cost-effective.

DESCRIPTION OF THE PREFERRED EMBODIMENTS

Figure 1:
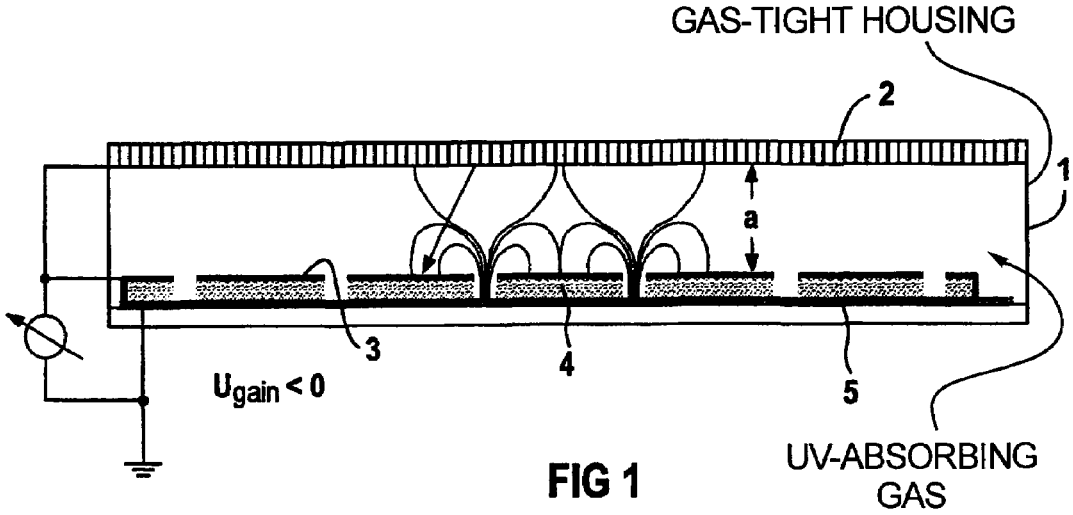
FIG. 1 is a schematic cross-sectional view of a radiation converter constructed and operating in accordance with the principles of the present invention.

The radiation converter shown in FIG. 1 has a gas-tight housing 1 with a radiation absorber 2, which converts radiation into light photons. The radiation absorber 2 is either embodied as a separate part or arranged outside the housing 1 in the region of a first side. The radiation absorber 2 is composed of a scintillator material, preferably CsI:Na in a needle structure, the needles being directed in the direction of a photocathode 3.

The photocathode 3 is arranged at a distance a of about 50 μm away from the radiation absorber 2 and is formed as a layer, preferably produced from copper, on a perforated polyimide film 4. The polyimide film 4 acts as an electron multiplier and is applied to an electron detector 5. The electron detector 5 preferably has a pixel structure and converts the impinging electrons into electrical signals which can be derived by means of suitable known measures, for example an electrical line, and which enable an image representation on a display device. For this purpose, the electron detector 5 is preferably embodied as a 2D thin-film panel and may preferably comprise a-Se, a-Si:H or poly-Si. A gas, in particular quenching gas, for example a mixture of argon and hydrocarbon, is accommodated within the housing 1, in particular between the radiation absorber 2 and the photocathode 3. For this purpose, the electron detector 5 is preferably embodied as a 2D thin-film panel and may preferably comprise a-Se, a-Si:H or poly-Si. A gas, in particular quenching gas, for example a mixture of argon and hydrocarbon, is accommodated within the housing 1, in particular between the radiation absorber 2 and the photocathode 3.

The device functions as follows:

X-rays are absorbed by the radiation absorber 2 and converted into photons in the process. The photons liberate photoelectrons from the photocathode 3. The photoelectrons pass into the region of the perforated polyimide film 4. A potential is applied between the photocathode 3 and the electron detector 5. What is achieved by the applied electrical potential is that all the photoelectrons are drawn from the surface of the photocathode 3 into the nearest holes. Charge carrier multiplication takes place in the greatly increasing electric field as a result of impact ionization. The charge carrier multiplication or amplification can be set by the magnitude of the applied potential. The signal/noise ratio thus can be improved. The photoelectrons are accelerated by the applied potential onto the electron detector. The charges accumulated there are read out with a predetermined timing sequence.

In order to reduce UV photons, the radiation absorber 2 may be provided with a UV-photon-absorbing conductive layer. The quenching gas absorbs the UV photons generated during the conversion by impact ionization, in order that said photons do not pass to the photocathode 3, where they could release photoelectrons in an undesired manner.

Figure 2:
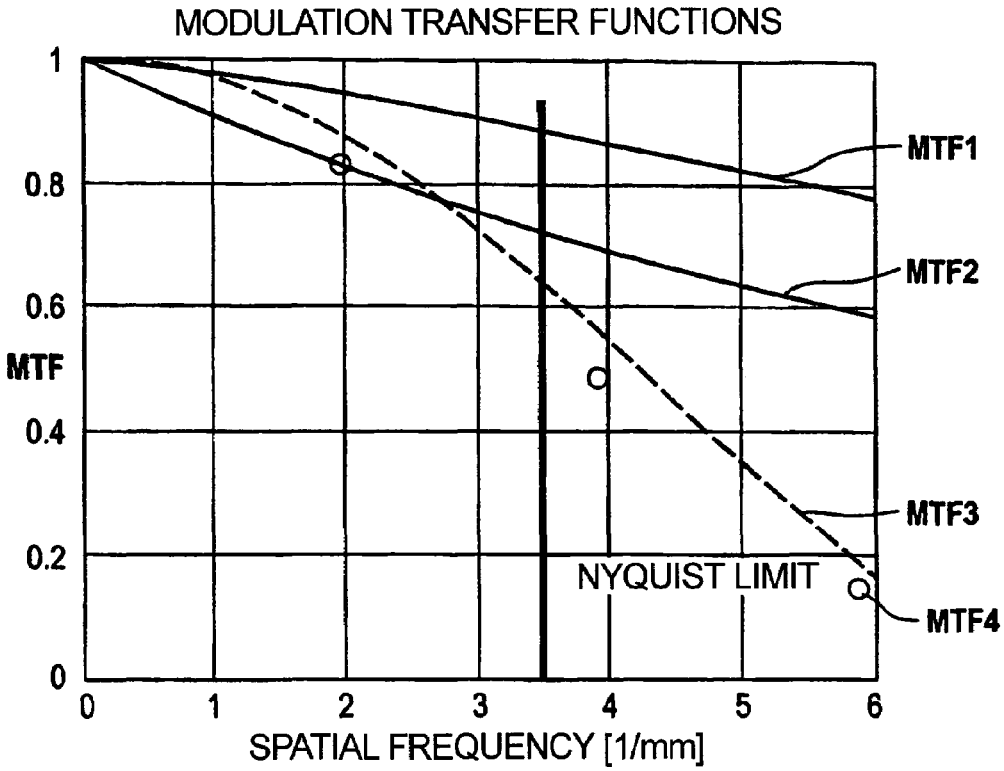
FIG. 2 is a graph showing the dependency of the modulation transfer function on the spatial frequency.

In FIG. 2, the modulation transfer function (MTE) is plotted against the spatial frequency. The curves MTF 1 and MTF 2 show the modulation transfer function in the case of a distance between the photocathode 3 and the radiation absorber 2 of 50 μm. The curve MTF 2 shows the point image function of an isotropic point source, and the curve MTF 1 shows the aforementioned point image function for a Lambert source.

The curve MTF 3 shows the modulation transfer function, here the radiation absorber 2 being in direct contact with the electron detector 5. The curve MTF 3 thus represents the characteristic of conventional flat detectors. The values MTF 4 specify the modulation transfer function for a Lambert source, the radiation absorber 2 being arranged at a distance of 50 mm from the electron detector 5. It is shown that the spaced-apart arrangement does not entail a significant change to the modulation transfer function.

Although modifications and changes may be suggested by those skilled in the art, it is the invention of the inventors to embody within the patent warranted heron all changes and modifications as reasonably and properly come within the scope of their contribution to the art.

The invention claimed is:

1. A radiation converter comprising:

a radiation absorber for generating photons dependent on an intensity of x-rays incident on said radiation absorber;

a photocathode disposed downstream of said radiation absorber in a propagation direction of said x-rays at a distance from said radiation absorber, said photocathode generating electrons dependent on said photons emerging from said radiation absorber;

an electron accelerator disposed for interacting with said electrons emerging from said photocathode for accelerating said electrons emerging from said photocathode;

an electron detector on which the electrons accelerated by said electron accelerator are incident, said electron detector generating electrical signals dependent thereon;

an electron multiplier disposed between said photocathode and said electron detector, for multiplying said electrons emerging from said photocathode; and a gas tight housing containing a UV photon-absorbing gas in which said radiation absorber, said electron multiplier and said electron detector are disposed.

2. A radiation converter as claimed in claim 1 wherein said photocathode is disposed a distance in a range between 10 and 100 μm from said radiation absorber.

3. A radiation converter as claimed in claim 1 wherein said photocathode is opaque.

4. A radiation converter as claimed in claim 1 wherein said photocathode is composed of a metallic material having a constituent selected from the group consisting of gold, cesium, copper and antimony.

5. A radiation converter as claimed in claim 1 wherein said photocathode is formed as a layer on said electron multiplier.

6. A radiation converter as claimed in claim 1 wherein said electron multiplier is formed as a layer on said electron detector.

7. A radiation converter as claimed in claim 1 wherein said electron multiplier has a perforated plastic film.

8. A radiation converter as claimed in claim 7 wherein said perforated plastic film is composed of polyimide.

9. A radiation converter as claimed in claim 1 wherein said gas has at least one constituent selected from the group consisting of argon, krypton, xenon, helium, neon, carbon dioxide, $N_2$, a hydrocarbon, dimethyl ether, and methanol/ethanol vapor.

10. A radiation converter as claimed in claim 1 wherein said radiation absorber comprises a scintillator material having an acicular structure.

11. A radiation converter as claimed in claim 10 wherein said scintillator material comprises CsI:Na.

12. A radiation converter as claimed in claim 1 wherein said electron detector is a 2-D thin-film panel.

13. A radiation converter as claimed in claim 12 wherein said 2D thin-film panel is formed of a material selected from the group consisting of a-Se, a-Si:H, and poly-Si.

* * * * *